US012215295B2

(12) United States Patent
Draese et al.

(10) Patent No.: US 12,215,295 B2
(45) Date of Patent: Feb. 4, 2025

(54) COOLING LUBRICANT FOR COLD ROLLING ALUMINUM

(71) Applicants: Stephan Draese, Nettetal (DE); Thomas Graf, Bonn (DE); Oliver Seiferth, Köln-Zündorf (DE); Volker Schmitz, Rommerskirchen (DE)

(72) Inventors: Stephan Draese, Nettetal (DE); Thomas Graf, Bonn (DE); Oliver Seiferth, Köln-Zündorf (DE); Volker Schmitz, Rommerskirchen (DE)

(73) Assignee: Speira GmbH, Grevenbroich (DE)

( * ) Notice: Subject to any disclaimer, the term of this patent is extended or adjusted under 35 U.S.C. 154(b) by 0 days.

(21) Appl. No.: 18/171,003

(22) Filed: Feb. 17, 2023

(65) Prior Publication Data

US 2023/0203395 A1 Jun. 29, 2023

Related U.S. Application Data

(63) Continuation of application No. PCT/EP2021/072781, filed on Aug. 17, 2021.

(30) Foreign Application Priority Data

Aug. 17, 2020 (EP) ..... 20191350

(51) Int. Cl.

| | |
|---|---|
| ***C10M 145/34*** | (2006.01) |
| ***C10M 101/00*** | (2006.01) |
| ***C10M 169/04*** | (2006.01) |
| ***C22F 1/04*** | (2006.01) |
| *C10N 20/00* | (2006.01) |
| *C10N 40/20* | (2006.01) |

(52) U.S. Cl.

CPC ..... *C10M 145/34* (2013.01); *C10M 101/00* (2013.01); *C10M 169/041* (2013.01); *C22F 1/04* (2013.01); *C10N 2020/093* (2020.05); *C10N 2040/243* (2020.05); *C10N 2040/245* (2020.05)

(58) Field of Classification Search

CPC ..... C22F 1/04; C10N 2040/245; C10N 2020/093; C10N 2040/243; C10M 101/00; C10M 145/34; C10M 169/041

See application file for complete search history.

(56) References Cited

U.S. PATENT DOCUMENTS

| | | | | |
|---|---|---|---|---|
| 3,871,837 | A | 3/1975 | Bedague et al. | |
| 3,919,093 | A | 11/1975 | Davis et al. | |
| 4,844,830 | A * | 7/1989 | Budd | B21B 3/00 508/505 |
| 4,949,566 | A | 8/1990 | Eichelbaum | |
| 6,059,976 | A * | 5/2000 | Kovolick | B01D 17/0208 210/708 |

FOREIGN PATENT DOCUMENTS

| | | | |
|---|---|---|---|
| EP | 0484542 | A1 | 5/1992 |
| EP | 2978828 | A1 | 2/2016 |
| JP | H06-128583 | A | 5/1994 |
| JP | H09208984 | A | 8/1997 |
| JP | H10-008080 | A | 1/1998 |
| JP | 2003096482 | A | 4/2003 |
| JP | 2009242700 | A | 10/2009 |
| JP | 2009242726 | A | 10/2009 |
| JP | 2003-165993 | A | 6/2023 |
| WO | WO 2014/189711 | A1 | 11/2014 |

OTHER PUBLICATIONS

Metalworking Chemicals. "Performance Products" Dec. 31, 2010 (Dec. 31, 2010). Retrieved from the Internet: http://www.huntsman.com/performance_products/MediaLibrary/a_MC34853 I CF A3EA9A2E040EBCD2B6B7B06/Products _MC348531D0B9F A9A2E040EBCD2B6B7B06/Amines _MC348 531D0BECA9A2E040EBCD2B6B7B06/Morpholine DGA_R_ MC348531D0D20A9A2E040EBCD2B6B7B06/DIGL YCOLAMINE_ Ragen_MC348531D0DBAA9A2E040EBCD2B6B7B06/files/ metalwo [retrieved on Jun. 17, 2014] XP055123809.

* cited by examiner

*Primary Examiner* — Vishal V Vasisth

(74) *Attorney, Agent, or Firm* — Reinhart Boerner Van Deuren P.C.

(57) ABSTRACT

Described is a cooling lubricant for cold rolling aluminum, which includes a mineral oil-based or synthetic base oil and a polyalkylene glycol or a compound with a polyalkylene oxide structure. Further, the cooling lubricant is not water-soluble or miscible with water, and the cooling lubricant is substantially free of fatty acids and fatty alcohols.

10 Claims, No Drawings

COOLING LUBRICANT FOR COLD ROLLING ALUMINUM

CROSS-REFERENCE TO RELATED PATENT APPLICATIONS

This patent application is a continuation of International Application No. PCT/EP2021/072781, filed on Aug. 17, 2021, which claims the benefit of priority to European Patent Application No. 20191350.6, filed Aug. 17, 2020, the entire teachings and disclosures of both applications are incorporated herein by reference thereto.

FIELD

The invention relates to a cooling lubricant (rolling oil) for cold rolling aluminum, to a method for producing an aluminum product that is free of visually discernible defect patterns caused by fatty acids, and to the use of the cooling lubricant for rolling aluminum.

BACKGROUND

In methods for producing aluminum strips and foils, rolling emulsions and rolling oils, which have a significant influence on the economic viability of production and the quality of the products, are used as a cooling lubricant. During rolling, the coefficient of friction between the work roll and the rolled material should not be too high or too low. A low coefficient of friction improves the lubrication in the roll gap, so that energy consumption, frictional heat and roll wear in the rolling process are reduced.

Aluminum strips and foils are generally produced by rolling in a two-stage rolling process. To produce an aluminum strip or an aluminum foil, an aluminum ingot is initially rolled into a blank or a strip in a plurality of passes in a so-called hot-rolling stand. This is subsequently subjected to cold rolling to form a thinner strip or a foil. Furthermore, the strip or foil can also undergo further known treatment methods (annealing, thermal or chemical degreasing).

A rolling emulsion (O/W) is usually used as a cooling lubricant during hot rolling, and a rolling oil is used during cold rolling. In the method step of hot rolling, the aluminum ingot is reshaped significantly to form an aluminum strip. In cold rolling stands, hydrocarbon-based rolling oils are used as cooling lubricants. Lubricating additives can be added to these rolling oils. Typical lubricating additives are, for example, fatty alcohols, fatty acids and fatty acid esters.

A disadvantage of the use of fatty acids is that the fatty acids which are used regularly, such as lauric acid, myristic acid, palmitic acid or stearic acid, are present as a solid at temperatures below 40° C. and only evaporate at temperatures significantly above 300° C. Therefore, after evaporation of the more volatile rolling oil, it is possible for solid or pasty deposits of fatty acids, and metal soaps formed therefrom, to arise on components in the roll stand which are not continuously washed over with rolling oil. When these solid or pasty deposits detach from the roll stand or pipelines and reach the aluminum strip or the aluminum foil, visually discernible defect patterns can arise on the rolled material, which can no longer be removed by the following method steps (further roll passes, roll cutting, thermal or chemical degreasing).

A further disadvantage of a fatty acid as a lubricating additive is that it can react with the components of the rolled material, in particular with the roll abrasion formed during reshaping. In this case, metal soaps, primarily aluminum soaps, can form. After oxidation of the alcohol to form acid, fatty alcohols can also react with aluminum abrasion to form aluminum soaps.

The aluminum soaps formed from the fatty acids used and aluminum abrasion have only limited and low solubility in the cold-rolling oil. In addition, they form agglomerates with the aluminum abrasion particles. These poorly soluble metal soaps and the metal soaps/metal abrasion agglomerates are deposited on the components of the cold rolling stand and can form the aforementioned deposits in pipelines and tanks.

If such metal soaps or metal soaps/metal abrasion agglomerates detach from components of the rolling machine, the cold rolling mill or from pipe walls and reach the aluminum strip or the aluminum foil, visually discernible defect patterns can also occur on the rolled material, which can no longer be removed by the following method steps to finish the strip or foil. To avoid such surface defects, it is known to separate metal soaps and metal abrasion from the cold-rolling oil by filtration or distillation processes. For this purpose, filters, such as horizontal pressure plate filters and filter aids, such as diatomaceous earth, perlite and bleaching earth, can be used. Increasing soap content in the rolling oil is counteracted by increased use of the bleaching earth filter aid. As a result, however, the filter stand time is shortened and both the quantity of filter aid required and the amount of filter waste produced are increased.

EP 3 124 583 A1 describes a water-soluble metalworking liquid comprising a dicarboxylic acid with sulfide structure, a polyalkylene glycol, a polyhydric alcohol/polyalkylene oxide adduct and a monocarboxylic acid. A water-soluble composition and not a mineral oil-based composition is therefore described.

EP 0 484 542 A1 describes a lubricant for metal working, which contains a fatty alcohol or a fatty acid in addition to a mineral oil and a straight-chain olefin. In addition, glycols may be present in the lubricant described therein. Glycols are not included in the example compositions of this document. A disadvantage of olefins in lubricants is that, after annealing of the aluminum strip, they result in high annealing residues on aluminum sheets.

EP 3 124 583 A1 describes a water-soluble metal treatment agent which can contain a polyalkylene glycol in addition to fatty acids and fatty alcohols.

There is, therefore, a need for new lubricating additives which do not form reaction products with aluminum abrasion and also do not react with other components of the rolling oil.

BRIEF SUMMARY

The invention is based on the object of providing a cooling lubricant by means of which the visually discernible defect patterns on aluminum strips or aluminum foils, which are frequently caused by fatty acids and/or fatty alcohols in cold rolling methods, can be avoided without impairing the lubricating effect and tribological activity of the rolling oil.

This object is achieved by a mineral oil-based cooling lubricant (rolling oil) for cold rolling aluminum. This contains

- a mineral oil-based or synthetic base oil,
- a polyalkylene glycol or a compound that contains a polyoxyalkylene structure, wherein
- the cooling lubricant is substantially free of fatty acids and fatty alcohols.

The invention further provides a method for producing an aluminum product (aluminum strip or aluminum foil) in which the aforementioned cooling lubricant is used for cold rolling an aluminum strip.

Finally, the invention provides for the use of the aforementioned cooling lubricant for cold rolling an aluminum strip to form a thinner aluminum strip than the aluminum strip that is not yet cold rolled or to form an aluminum foil (aluminum product).

The aluminum product obtained is free of visually discernible defect patterns caused by fatty acids and fatty alcohols. It has a surprisingly high wettability for water and N-methyl-2-pyrrolidone (NMP). Furthermore, the aluminum product does not require any corona treatment if a high surface energy of the surface of the aluminum foil is desired.

DETAILED DESCRIPTION

The cooling lubricant according to the invention is oil-soluble; it is not miscible with water. The cooling lubricant according to the invention is free of straight-chain olefins, in particular free of alpha-olefins having 6 to 40 carbon atoms.

Within the meaning of the invention, substantially free of a fatty acid means that a fatty acid is contained in the cooling lubricant as a lubricating additive in a proportion of at most 0.2 wt. %, preferably at most 0.1 wt. %, based on the mass of the cooling lubricant. Within the meaning of the invention, substantially free of a fatty alcohol means that a fatty alcohol is contained in the cooling lubricant as a lubricating additive in a proportion of at most 0.4 wt. %, preferably at most 0.3 wt. %, based on the mass of the cooling lubricant. If the fatty acid content and/or the fatty alcohol content in the lubricant according to the invention are above the maximum value specified above, the wetting properties of the aluminum product rolled therewith are impaired.

Aluminum products within the meaning of the invention are aluminum sheets, aluminum strips and aluminum foils, which have been subjected to cold rolling. An aluminum foil can, for example, have a thickness of 4 to 100 μm or else be thicker than 100 μm. The term aluminum within the meaning of the invention coves aluminum and aluminum alloys.

Polyalkylene glycols to be used according to the invention comprise typical polyalkylene glycols and compounds having a polyalkylene glycol structure, such as polyoxyalkylene fatty alcohol ether (ethoxylated fatty alcohol). The alkylene group in the polyalkylene glycol or polyalkylene oxide may be ethylene, propylene or butylene (polyethylene glycols, polypropylene glycols, polybutylene glycols). The fatty alcohol can comprise 8 to 20 carbon atoms. The fatty alcohol group can be, for example, decanol, lauryl alcohol, myristyl alcohol, cetyl alcohol, or stearyl alcohol. These compounds have lubricating and cooling properties during the cold rolling of aluminum. The term polyalkylene glycol used below covers polyalkylene glycols and compounds having a polyalkylene glycol structure.

The polyalkylene glycols used according to the invention can have a kinematic viscosity of 5 $mm^2/s$ to 250 $mm^2/s$, preferably 10 $mm^2/s$ to 200 $mm^2/s$ at 40° C. The polyalkylene glycols used according to the invention are present as liquid above 5° C. and are therefore easy to dose. They can be insoluble in water or soluble in water.

Particularly preferably, ethoxylated fatty alcohols, such as tetraethylene glycol monododecyl ether, are used as polyalkylene glycols or a compound that contains a polyalkylene oxide. Corresponding polyalkylene glycols are commercially available.

The proportion of the polyalkylene glycol in the rolling oil according to the invention can be up to 10 wt. %, in particular 0.01 to 8 wt. % and particularly preferably 0.1 to 5 wt. %, in each case based on the mass of the rolling oil. The polyalkylene glycol therefore replaces the fatty acid and fatty alcohol additives usually present in cold-rolling lubricants. The cooling lubricant according to the invention has a good lubricating effect or tribological effect without the aforementioned disadvantageous effects of fatty acids and fatty alcohols.

The cooling lubricant according to the invention is based on a hydrocarbon base oil having a boiling point in the range of 180 to 300° C., measured according to DIN EN ISO 3405. The base oil contains straight-chain and branched hydrocarbons. The base oil can comprise a hydrocarbon mixture. The proportion of aromatics therein can preferably be less than 1 wt. %, based on the mass of the base oil. The base oil can be a mineral oil or a synthetic oil. It can comprise natural and/or synthetic n-paraffins and/or natural and/or synthetic isoparaffins.

The kinematic viscosity of this low-aromatic hydrocarbon mixture can be 1.5 to 3.6 $mm^2/s$ at 20° C. Said kinematic viscosity provides good flow properties in the cold rolling stand and allows uniform lubrication and cooling. The proportion of the base oil in the cooling lubricant according to the invention can make up 90 wt. % and more, based on the mass of the cooling lubricant. The proportion of the base oil can be, for example, 90 wt. % to 99 wt. % of the mass of the cooling lubricant.

The cooling lubricant according to the invention can comprise typical additives for increasing the high-pressure lubricating properties, antioxidants and conductivity improvers.

Additives for increasing the high-pressure lubricating properties include esters of straight-chain saturated $C_{10-14}$ carboxylic acids. They include, for example, butyl stearate and methyl dodecanoate. Methyl dodecanoate is particularly preferred. They can be contained in an amount of up to 10 wt. %, preferably 1 to 8 wt. %, based on the mass of the cooling lubricant.

Suitable antioxidants include sterically hindered monohydric, dihydric and trihydric phenols and polynuclear phenols, in particular tert-butylphenols. A typical representative of this group is methylene 4,4'-bis-(2,6-di-tert-butylphenol). Further suitable antioxidants include amines, such as diphenylamine, phenyl-α-naphthylamine, p,p'-tetramethyl diaminodiphenylmethane and N,N'-diphenyl-p-phenylediamine. An aforementioned antioxidant can be used in combination with further antioxidants, such as sulfides and polydisulfides in typical concentrations.

The cooling lubricant according to the invention allows the further processing of the aluminum product obtained after the cold rolling for a series of applications, without a corona treatment being required. Nevertheless, a surface energy is achieved on the surface of the aluminum products, as exists after corona treatment on aluminum products which have been cold-rolled in the presence of fatty acids and fatty alcohols. Furthermore, the surface of the aluminum product has a high wettability for water and N-methyl-2-pyrrolidone (NMP).

The aluminum product contains, on its surface, residues of the polyalkylene glycol used in the cooling lubricant according to the invention. The amount of polyalkylene glycol on the aluminum product after the cold rolling can be up to 5 $mg/m^2$ or more. After the method according to the invention has been carried out, for example 0.01 $mg/m^2$ to 5 $mg/m^2$ of polyalkylene glycol or a compound containing a polyalkylene oxide structure can be found on the surface of the aluminum product.

It was found that the lubricant according to the invention achieves a significant reduction in the number of visually discernible defect patterns on the aluminum strips or aluminum foils produced. This is probably due to the fact that rolling oil components do not form deposits on the rolled material that are difficult to remove. The omission of fatty alcohols appears to increase this reduction. Residues of the rolling oil according to the invention can be easily removed chemically or thermally from the surface of the rolled material or the surface of the rolled product has only a slight formation of residue after thermal degreasing.

It is expedient to heat the cooling lubricant according to the invention to at least approximately 40° C. before it is used. This reduces its viscosity and allows faster flow through the roll gap.

The following examples are used to further explain the invention.

EXAMPLES

Example 1—Determination of the Coefficients of Friction of Various Lubricants The lubricating properties of the cooling lubricant according to the invention were determined using an MTM2 mini-traction machine from PCS Instruments in standard configuration with a steel ball (diameter 19.05 mm) exerting a load and an aluminum test disk which is rotatable at different speeds. The load on the test disk by the ball (¾" ball bearing steel AISI 52100 (100Cr6, 1.3505)) was set to 40 N (0.5 GPa contact pressure) and coefficients of friction (CF) at different rolling speeds of. The two mean values (MV) of the coefficients of friction measured at rolling speeds of 1 to 200 m/min are reproduced in Table 1 below. The disk was formed from an aluminum alloy AA1XXX. The slide/roll ratio (SRR) during the test was 50%. After the tribological test, the wettability of the aluminum test disks with respect to water was tested. For this purpose, drop tests with a drop volume of 5 μl were carried out with demineralized water on the disks next to the track. The standardized test procedure corresponds to the internal work instruction "Hydro CO 0620". The kinematic viscosity was measured in accordance with DIN 51562 at 40° C.

TABLE 1

| Lubricant sample | Viscosity $mm^2/s$ | CF MV 0.2-200 m/min | Droplet size 5 μl of water in mm | Comments |
|---|---|---|---|---|
| 1 Base oil | 1.9 | 0.07; 0.08 | 3.1 | Lubricating film formation suboptimal; metal soap formation |
| 2 Base oil + 0.9% fatty acid + 0.9% methyl laurate | 1.9 | 0.06; 0.05 | 2.5 | Good lubricating film; more abrasion in the KSS but clean disk |
| 3 Rolling oil with 1% PAG* (viscosity 20 $mm^2/s$ at 40° C.) | 1.9 | 0.05; 0.05 | 3.1 | Better lubricating film formation than pure rolling oil |
| 4 Rolling oil with 2% PAG* (viscosity 20 $mm^2/s$ at 40° C.) | 1.9 | 0.04; 0.04 | 3.5 | Lubricating film formation good; minimal track on the ball |
| 5 Rolling oil with 4% PAG* (viscosity 20 $mm^2/s$ at 40° C.) | 2.0 | 0.03; 0.03 | 3.5 | Hardly any abrasion |
| 6 Rolling oil with 2% PAG-containing compound** (viscosity 20 $mm^2/s$ at 40° C.) | 1.9 | 0.06; 0.06 | 3.3 | Good lubricating film formation; some abrasion; acceptable wetting |
| 7 Rolling oil with 5% PAG-containing compound** (viscosity 20 $mm^2/s$ at 40° C.) | 2.0 | 0.05; 0.06 | 6.6 | Good lubricating film formation; some abrasion; good wetting |
| 8 Rolling oil with 10% PAG-containing compound** (viscosity 20 $mm^2/s$ at 40° C.) | 2.2 | 0.03; 0.03 | 10.7 | Good lubricating film formation; hardly any abrasion; very good wetting |
| 9 Rolling oil with 5% PAG*** (viscosity 33 $mm^2/s$ at 40° C.) | 2.1 | 0.06; 0.08 | 3.6 | Lubricating film formation good |
| 10 Rolling oil with 5% PAG*** (viscosity 57 $mm^2/s$ at 40° C.) | 2.1 | 0.09; 0.08 | 4.5 | Lubricating film formation good; hardly any abrasion, hardly any track on the ball |
| 11 Rolling oil with 5% PAG*** (viscosity 77 $mm^2/s$ at 40° C.) | 2.1 | 0.07; 0.07 | 3.5 | Lubricating film formation good; minimal track on the ball |

TABLE 1-continued

| Lubricant sample | Viscosity $mm^2/s$ | CF MV 0.2-200 m/min | Droplet size 5 µl of water in mm | Comments |
|---|---|---|---|---|
| 12 Rolling oil with 5% PAG**** (viscosity 175 mm2/s at 40° C.) | 2.3 | 0.08; 0.06 | 3.3 | Lubricating film formation good; minimal track on the ball |

*PAG = an EO/PO copolymer with a kinematic viscosity of 20 $mm^2/s$ at 40° C.
**a polyethylene glycol monododecyl ether having a kinematic viscosity of 20 $mm^2/s$ at 40° C.
***in each case: Polypropylene glycol) monobutyl ether with kinematic viscosities of 33, 57 and 77 $mm^2/s$ at 40° C.
****Mixture of polypropylene glycols with kinematic viscosities of 75 and 225 $mm^2/s$ at 40° C., viscosity of the mixture is 175 $mm^2/s$ at 40° C.

The formation of lubricating film with the base oil alone is suboptimal; metal soap is formed. Lubricant sample 2 provides a good lubricating film with more abrasion but with a clean disk. Lubricant sample 3 according to the invention provides better lubricating film formation. The same applies to sample 4, which moreover hardly shows any track on the ball. This also applies to sample 5 which provides hardly any abrasion. Samples 6 to 12 show good lubricating film formation. Samples 6 and 7 some abrasion, sample 8 shows hardly any abrasion. Sample 6 shows acceptable wetting with water, sample 7 good wetting and sample 8 very good wetting with water. Sample 10 delivers hardly any abrasion and hardly any track on the ball. Samples 11 and 12 provide minimal track on the ball.

Example 2 — Determination of the Wetting Angle After Rolling With Different Lubricants An aluminum foil of an AA1XXX (type alloy was also used in the following test for determining the wetting angle on the surface of the foil. The contact angles (CA) were measured during wetting with water and with NMP. The wetting angle or contact angle was determined in the drop test at a drop volume of 5 µl with fully demineralized water or NMP using the drop shape analyzer DSA 10 from Krüss GmbH, Hamburg, Germany. The measurements are mean values of individual measurements at four different positions on the surface of the foil sample. The results of the measurements are shown in Table 2 below. Furthermore, the surface energy (SFE) was determined by determining the contact angle. Corresponding values are given in Table 2.

TABLE 2

| | Occupancy | | |
|---|---|---|---|
| | CA vs. $H_2O$ | SFE (total) mN/m | CA vs. NMP |
| Rolling oil (base oil) | 71° | 30 | 32° |
| Base oil with 0.1% fatty acid LA | 87° | 26 | 38° |
| Base oil with 0.5% fatty acid LA | 111° | 20 | 67° |
| Base oil with 1% fatty alcohol C12 | 78° | 26 | 40° |
| Base oil with 1% fatty alcohol C12/C14 (70:30) | 92° | 22 | 46° |
| Base oil with 2% fatty alcohol C12/C14 (70:30) | 85° | 22 | 43° |
| Base oil with 0.1% of a PAG-containing compound* (viscosity 20 $mm^2/s$ at 40° C.) | 74° | 34 | 20° |
| Base oil with 0.5% of a PAG-containing compound* (viscosity 20 $mm^2/s$ at 40° C.) | 75° | 29 | 24° |

TABLE 2-continued

| | Occupancy | | |
|---|---|---|---|
| | CA vs. $H_2O$ | SFE (total) mN/m | CA vs. NMP |
| Base oil with 1% of a PAG-containing compound* (viscosity 20 $mm^2/s$ at 40° C.) | 69° | 32 | 25° |
| Base oil with 0.5% PAG** (viscosity 77 $mm^2/s$ at 40° C.) | 53° | 45 | 20° |
| Base oil with 5% PAG** (viscosity 77 $mm^2/s$ at 40° C.) | 62° | 37 | 17° |

*Polyethylene glycol monodecyl ether
**Polypropylene glycol) monobutyl ether

The results reproduced in Table 2 show that the lubricants with a compound having a polyalkylene oxide structure result in aluminum products with considerably smaller contact angles, at least for NMP. This can be helpful for certain applications.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method, comprising:

utilizing a cooling lubricant for rolling aluminum, the cooling lubricant comprising:

a mineral oil-based or synthetic base oil, a polyalkylene glycol selected from the group consisting of polyethylene glycol, polypropylene glycol, polybutylene glycol, an ethoxylated fatty alcohol, and combinations thereof, wherein the ethoxylated fatty alcohol is a polyethylene glycol monododecyl ether, wherein the cooling lubricant is not water-soluble or miscible with water, the cooling lubricant is substantially free of fatty acids and fatty alcohols, wherein substantially free means that a fatty acid as a lubricating additive is contained in a proportion of at most 0.2 wt. %, based on the mass of the cooling lubricant, and a fatty alcohol as a lubricating additive is contained in a proportion of at most 0.4 wt. %, based on the mass of the cooling lubricant, the cooling lubricant is free of straight-chain olefins.

2. The method of claim 1, wherein the proportion of the polyalkylene glycol or of the ethoxylated fatty alcohol in the cooling lubricant is 0.01 to 10 wt. %, based on the mass of the cooling lubricant.

3. The method of claim 1, wherein the base oil of the cooling lubricant is present in a proportion of at least 85 wt. % based on the mass of the cooling lubricant.

4. The method of claim 1, wherein the cooling lubricant contains a fatty acid ester in an amount of up to 10 wt. %, based on the mass of the cooling lubricant.

5. The method of claim 4, wherein the fatty acid ester is selected from methyl esters of saturated, straight-chain C10-14 fatty acids.

6. A method for cold rolling an aluminum product that is free of visually discernible defect patterns caused by fatty acids, comprising using a cooling lubricant for cold rolling an aluminum strip, the cooling lubricant comprising:

a mineral oil-based or synthetic base oil, a polyalkylene glycol selected from a group consisting of polyethylene glycol, polypropylene glycol, polybutylene glycol, an ethoxylated fatty alcohol, and combinations thereof, wherein the ethoxylated fatty alcohol is a polyethylene glycol monododecyl ether, wherein the cooling lubricant is not water-soluble or miscible with water, the cooling lubricant is substantially free of fatty acids and fatty alcohols, wherein substantially free means that a fatty acid as a lubricating additive is contained in a proportion of at most 0.2 wt. %, based on the mass of the cooling lubricant, and a fatty alcohol as a lubricating additive is contained in a proportion of at most 0.4 wt. %, based on the mass of the cooling lubricant, the cooling lubricant is free of straight-chain olefins.

7. The method of claim 1, wherein the polyethylene glycol monododecyl ether is a tetraethylene glycol monododecyl ether.

8. The method of claim 1, wherein the base oil of the cooling lubricant is present in a proportion of at least 90 wt. % based on the mass of the cooling lubricant.

9. The method of claim 4, wherein the fatty acid ester is methyl dodecanoate.

10. The method of claim 1, wherein utilizing a cooling lubricant for rolling aluminum further comprises utilizing the cooling lubricant for cold rolling aluminum.

* * * * *